US010586557B2

(12) United States Patent
Muesch

(10) Patent No.: US 10,586,557 B2
(45) **Date of Patent: *Mar. 10, 2020**

(54) VOICE ACTIVITY DETECTOR FOR AUDIO SIGNALS

(71) Applicant: Dolby Laboratories Licensing Corporation, San Francisco, CA (US)

(72) Inventor: Hannes Muesch, Oakland, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/516,634

(22) Filed: Jul. 19, 2019

(65) Prior Publication Data

US 2019/0341069 A1 Nov. 7, 2019

Related U.S. Application Data

(63) Continuation of application No. 15/730,908, filed on Oct. 12, 2017, now Pat. No. 10,418,052, which is a (Continued)

(51) Int. Cl.
*G10L 25/78* (2013.01)
*G10L 19/018* (2013.01)

(Continued)

(52) U.S. Cl.
CPC ..... *G10L 25/78* (2013.01); *G10L 19/012* (2013.01); *G10L 19/018* (2013.01); *G10L 21/02* (2013.01);

(Continued)

(58) Field of Classification Search
CPC ..... G10L 25/78
See application file for complete search history.

(56) References Cited

U.S. PATENT DOCUMENTS 3,803,357 A 4/1974 Sacks
4,628,529 A 12/1986 Borth (Continued)

FOREIGN PATENT DOCUMENTS

EP 1739657 1/2007
EP 1853093 11/2007

(Continued)

OTHER PUBLICATIONS

American National Standards Institute, "Methods for Calculation of the Speech Intelligibility Index", ANSI S3.5 1997.

(Continued)

*Primary Examiner* — Douglas Godbold

(57) ABSTRACT

According to one aspect, a method for determining voice activity is disclosed, the method including receiving a frame of an input audio signal, the input audio signal having a sample rate, and spitting the audio signal into a plurality of subbands, the plurality of subbands including at least a lowest subband and a highest subband. The method further comprises filtering the lowest subband to reduce an energy of the lowest subband, estimating a noise level for at least some of the plurality of subbands, and computing a signal-to-noise ratio for at least some of the plurality of subbands. The method also includes determining a speech activity level based at least in part on the computed signal-to-noise ratios and an average of an energy of at least some of the plurality of subbands.

6 Claims, 4 Drawing Sheets

Related U.S. Application Data continuation of application No. 15/207,155, filed on Jul. 11, 2016, now Pat. No. 9,818,433, which is a continuation of application No. 14/701,622, filed on May 1, 2015, now Pat. No. 9,418,680, which is a continuation of application No. 14/605,003, filed on Jan. 26, 2015, now Pat. No. 9,368,128, which is a continuation of application No. 13/571,344, filed on Aug. 10, 2012, now Pat. No. 8,972,250, which is a continuation of application No. 13/463,600, filed on May 3, 2012, now Pat. No. 8,271,276, which is a continuation of application No. 12/528,323, filed as application No. PCT/US2008/002238 on Feb. 20, 2008, now Pat. No. 8,195,454.

(60) Provisional application No. 60/903,392, filed on Feb. 26, 2007.

(51) Int. Cl.

| | |
|---|---|
| ***G10L 21/0364*** | (2013.01) |
| ***G10L 25/93*** | (2013.01) |
| ***G10L 19/012*** | (2013.01) |
| ***G10L 21/02*** | (2013.01) |

(52) U.S. Cl.

CPC ..... *G10L 21/0205* (2013.01); *G10L 21/0364* (2013.01); *G10L 25/93* (2013.01); *G10L 2025/932* (2013.01); *G10L 2025/937* (2013.01)

(56) References Cited

U.S. PATENT DOCUMENTS 4,661,981 A 4/1987 Henrickson
4,672,669 A 6/1987 Desblache
4,912,767 A 3/1990 Chang
5,251,263 A 10/1993 Andrea
5,263,091 A 11/1993 Waller, Jr.
5,388,185 A 2/1995 Terry
5,394,473 A 2/1995 Davidson
5,400,405 A 3/1995 Petroff
5,425,106 A 6/1995 Katz
5,539,806 A 7/1996 Allen
5,583,962 A 12/1996 Davis
5,596,676 A 1/1997 Swaminathan
5,623,491 A 4/1997 Skoog
5,632,005 A 5/1997 Davis
5,633,981 A 5/1997 Davis
5,689,615 A 11/1997 Benyassine
5,727,119 A 3/1998 Davidson
5,774,557 A 6/1998 Slater
5,812,969 A 9/1998 Barber, Jr.
5,864,311 A 1/1999 Johnson
5,872,531 A 2/1999 Johnson
5,884,255 A * 3/1999 Cox ..... G10L 25/78 704/233
5,907,822 A 5/1999 Prieto, Jr.
5,907,823 A 5/1999 Sjoberg
5,963,901 A 10/1999 Vaehaetalo
6,005,953 A 12/1999 Stuhlfelner
6,021,386 A 2/2000 Davis
6,061,431 A 5/2000 Knappe
6,104,994 A 8/2000 Su
6,122,611 A 9/2000 Su
6,169,971 B1 1/2001 Bhattacharya
6,188,981 B1 2/2001 Benyassine
6,198,830 B1 3/2001 Holube
6,208,618 B1 3/2001 Kenney
6,208,637 B1 3/2001 Eames
6,223,154 B1 4/2001 Nicholls
6,246,345 B1 6/2001 Davidson
6,289,309 B1 9/2001 DeVries
6,351,733 B1 2/2002 Saunders
6,449,593 B1 9/2002 Valve
6,453,289 B1 9/2002 Ertem
6,477,489 B1 11/2002 Lockwood
6,570,991 B1 5/2003 Scheirer
6,597,791 B1 7/2003 Klayman
6,615,169 B1 9/2003 Ojala
6,618,701 B2 9/2003 Piket
6,631,139 B2 10/2003 El-Maleh
6,633,841 B1 10/2003 Thyssen
6,785,645 B2 8/2004 Khalil
6,813,490 B1 11/2004 Lang
6,862,567 B1 3/2005 Gao
6,885,988 B2 4/2005 Chen
6,898,566 B1 5/2005 Benyassine
6,914,988 B2 7/2005 Irwan
6,922,669 B2 7/2005 Schalk
6,937,980 B2 8/2005 Krasny
6,993,480 B1 1/2006 Klayman
7,020,605 B2 3/2006 Gao
7,120,578 B2 10/2006 Thyssen
7,174,022 B1 2/2007 Zhang
7,181,034 B2 2/2007 Armstrong
7,191,123 B1 3/2007 Besette
7,197,146 B2 3/2007 Malvar
7,203,638 B2 4/2007 Jelinek
7,231,347 B2 6/2007 Zakarauskas
7,246,058 B2 7/2007 Burnett
7,283,956 B2 10/2007 Ashley
7,343,284 B1 3/2008 Gazor
7,398,207 B2 7/2008 Riedl
7,440,891 B1 10/2008 Shozakai
7,454,331 B2 11/2008 Vinton
7,469,208 B1 12/2008 Kincaid
7,653,537 B2 1/2010 Kabi
7,668,713 B2 2/2010 Zinser, Jr.
RE43,191 E 2/2012 Arslan
8,170,882 B2 5/2012 Davis
8,175,888 B2 5/2012 Ashley
9,418,680 B2 * 8/2016 Muesch ..... G10L 21/0205
2002/0116176 A1 8/2002 Tsourikov
2002/0152066 A1 10/2002 Piket
2003/0044032 A1 3/2003 Irwan
2003/0046069 A1 3/2003 Vergin
2003/0179888 A1 9/2003 Burnett
2003/0182104 A1 9/2003 Muesch
2003/0198357 A1 10/2003 Schneider
2004/0190740 A1 9/2004 Chalupper
2005/0141737 A1 6/2005 Hansen
2005/0143989 A1 6/2005 Jelinek
2005/0182620 A1 8/2005 Kabi
2005/0192798 A1 9/2005 Vainio
2005/0240401 A1 10/2005 Ebenezer
2005/0246179 A1 11/2005 Kraemer
2005/0267745 A1 12/2005 Laaksonen
2005/0278171 A1 12/2005 Suppappola
2006/0045139 A1 3/2006 Black
2006/0053007 A1 3/2006 Niemisto
2006/0074646 A1 4/2006 Alves
2006/0095256 A1 5/2006 Nongpiur
2006/0224381 A1 10/2006 Makinen
2006/0282262 A1 12/2006 Vos
2007/0078645 A1 4/2007 Niemisto
2007/0147635 A1 6/2007 Dijkstra
2007/0198251 A1 8/2007 Jaber
2008/0071540 A1 3/2008 Nakano
2008/0201138 A1 8/2008 Visser
2009/0070118 A1 3/2009 Den Brinker
2009/0161883 A1 6/2009 Katsianos
2011/0184734 A1 * 7/2011 Wang ..... G10L 25/78 704/233
2013/0151246 A1 * 6/2013 Jarvinen ..... G10L 25/78 704/214
2013/0304464 A1 * 11/2013 Wang ..... G10L 25/78 704/233
2014/0126737 A1 * 5/2014 Burnett ..... H04R 3/005 381/71.6

(56) References Cited

U.S. PATENT DOCUMENTS

| | | | | |
|---|---|---|---|---|
| 2015/0142426 | A1* | 5/2015 | Song | G10L 21/0208 704/226 |
| 2015/0187364 | A1* | 7/2015 | Sehlstedt | G10L 19/0204 704/226 |
| 2015/0243299 | A1* | 8/2015 | Sehlstedt | G10L 25/78 704/226 |

FOREIGN PATENT DOCUMENTS

| | | |
|---|---|---|
| JP | 8305398 | 11/1996 |
| JP | 2002-169599 | 6/2002 |
| RU | 2142675 | 12/1999 |
| RU | 2284585 | 9/2006 |
| WO | 99/53612 | 10/1999 |
| WO | 01/65888 | 9/2001 |
| WO | 02/080147 | 10/2002 |
| WO | 2005/052913 | 6/2005 |
| WO | 2005/117483 | 12/2005 |
| WO | 2006/027717 | 3/2006 |
| WO | 2007/073818 | 7/2007 |
| WO | 2007/082579 | 7/2007 |
| WO | 2008/106036 | 9/2008 |

OTHER PUBLICATIONS

ATSC Standard A52/A: Digital Audio Compression Standard (AC-3, E-AC-3), Revision B, Adv. TV Systems Committee, Jun. 14, 2005.

ATSC Standard: Digital Television Standard (A/53), revision D, Including Amendment No. 1, Section 6.5 Hearing Impaired (HI).

Basbug, Filiz et al., "Robust Voice Activity Detection for DTX Operation of Speech Coders", Speech Coding Proceedings, 1999 IEEE Workshop on Porvoo, Finland, IEEE US, pp. 58-60, Jun. 20, 1999, Piscataway, NJ.

Beritelli, F., et al., "Performance Evaluation and Comparison of G.729/AMR/Fuzzy Voice Activity Detectors", IEEE Signal Processing Letters, vol. 9, No. 3, Mar. 2002, Piscataway, NJ.

Bosi, et al., "ISO/IEC MPEG-2 Advanced Audio Coding", Proc. of the 101st AES-Convention, J. Audio Eng. Soc., vol. 45, No. 10, Oct. 1997 .

Bosi, M., et al., "High Quality, Low-Rate Audio Transform Coding for Transmission and Multimedia Applications", Audio Engineering Society Preprint 3365, 93rd AES Convention, Oct. 1-4, 1992.

Brandenburg, K., "MP3 and AAC explained", Proc. of the AES 17th Intl Conference on High Quality Audio Coding, Florence Italy, 1999.

Davis, Mark, "The AC-3 Multichannel Coder", Audio Engineering Society Preprint 3774, 95th AES Convention, Oct. 1003.

Derakhshan, N., et al., "Speech Enhancement in Harsh Noisy Environment Using Analytic Decomposition of Speech Signal in Critical Bands" IEEE Explore Signal Processing and its Applications 9th International Symposium, pp. 1-4, Feb. 12-15, 2007.

Dillon, H., "Prescribing Hearing Aid Performance", Hearing Aids, Prescription for Nonlinear Amplification, Chapter 9, pp. 249-261, Sydney, Boomerang Press. 2001.

Dolby Laboratories, "Dolby Digital Professional Encoding Guidelines", available at http://www.beussery.com/pdf/beussery.dolby.pdf.

Grill et al., Intl Standard, "Information Technology—Very Low Bitrate Audio-Visual Coding", ISO/JTC 1/SC 29/WG11 ISO/IEC IS-14496 (Part 3, Audio) ISO/IEC 14496-3 Subpart 1:1998.

Intl Standard "Information technology-Generic coding of moving pictures and associated audio information—Part 7: Advanced Audio Coding (AAC)", ISO/IEC 13818-7:1997(E) 1st edition Dec. 1, 1997.

Killion, M., "New Thinking on Hearing in Noise: A Generalized Articulation Index", Seminars in Hearing, vol. 23, No. 1, 2002, pp. 57-75.

Musch, H. et al., "Using statistical decision theory to predict speech intelligibility. I. Model Structure", J. Acous. Soc. Am. 109 (6) Jun. 2001, pp. 2896-2909.

Nagata, Y., et al., "Speech Enhancement Based on Auto Gain Control" Audio, Speech and Language Processing, IEEE Transactions, vol. 14, No. 1, pp. 177-190, Jan. 2006.

Robinson, C., et al., "Dynamic Range Control via Metada", Convention Paper 5028, 107th AES, New York, Sep. 1999.

Sallberg, B., et al., "A Mixed Analog-Digital Hybrid for Speech Enhancement Purposes" Circuits and Systems, IEEE International Symposium, pp. 852-855, vol. 2, May 23-26, 2005.

Soulodre, G. A., et al., "Subjective Evaluation of State-of-the-Art Two-Channel Audio Codecs", J. Audio Eng. Soc., vol. 46, No. 3, pp. 164-177, Mar. 1998.

Todd, C.C., "Loudness uniformity and dynamic range control for digital multichannel audio broadcasting", Broadcasting Convention, Intl Amsterdam Netherlands, Jan. 1, 1995, pp. 149.

Tsoukalas, D., et al., "Speech Enhancement Using Psychoacoustic Criteria", Int'l Conf. on Acoustics, Speech, and Signal Processing, Apr. 27-30, 1993, vol. 2, pp. 359-362.

Vernon, Steve, "Design and Implementation of AC-3 Coders", IEEE Trans. Consumer Electronics, vol. 41, No. 3, Aug. 1995.

Virag, Nathalie, Single Channel Speech Enhancement Based on Masking Properties of the Human Auditory System, IEEE Transactions on Speech and Audio Processing, Mar. 1, 1999, vol. 7, No. 2, pp. 126-137.

3GPP2 C.S0052-A, Version 1.0, "Source-Controlled Variable-Rate Multimode Wideband Speech Codec (VMR-WB), Service Options 62 and 63 for Spread Spectrum Systems" 3rd Generation Partnership Project 2 "3GPP2", Apr. 22, 2005, pp. 1-198.

Jelinek, M. et al "Robust Signal/Noise Discrimination for Wideband Speech and Audio Coding" IEEE Workshop on Speech Coding, Sep. 17-20, 2000, Delavan, WI, USA, pp. 151-153.

* cited by examiner

VOICE ACTIVITY DETECTOR FOR AUDIO SIGNALS

CROSS REFERENCE TO RELATED APPLICATIONS

This application is a continuation of U.S. patent application Ser. No. 15/730,908 filed on Oct. 12, 2017, which is a continuation of U.S. patent application Ser. No. 15/207,155 filed on Jul. 11, 2016, now U.S. Pat. No. 9,818,433 issued on Nov. 14, 2017, which is a continuation of U.S. patent application Ser. No. 14/701,622 filed on May 1, 2015, now U.S. Pat. No. 9,418,680 issued on Aug. 16, 2016, which is a continuation of U.S. patent application Ser. No. 14/605,003 filed on Jan. 26, 2015, now U.S. Pat. No. 9,368,128 issued on Jun. 14, 2016, which is a continuation of U.S. patent application Ser. No. 13/571,344 filed on Aug. 10, 2012, now U.S. Pat. No. 8,972,250 issued on Mar. 3, 2015, which is a continuation of U.S. patent application Ser. No. 13/463,600 filed on May 3, 2012, now U.S. Pat. No. 8,271,276 issued on Sep. 18, 2012, which is a continuation of U.S. patent application Ser. No. 12/528,323 filed on Aug. 22, 2009, now U.S. Pat. No. 8,195,454 issued on Jun. 5, 2012, which is a national application of PCT application PCT/US2008/002238 filed Feb. 20, 2008, which claims the benefit of the filing date of U.S. Provisional Patent Application Ser. No. 60/903,392 filed on Feb. 26, 2007, all of which are hereby incorporated by reference.

TECHNICAL FIELD

The invention relates to audio signal processing. More specifically, the invention relates to detecting voice activity in an audio signal. The invention relates to methods, apparatus for performing such methods, to software stored on a computer-readable medium for causing a computer to perform such methods, and audio decoders that are capable of decoding bitstreams that were encoded using the described voice activity detector.

BACKGROUND ART

Audiovisual entertainment has evolved into a fast-paced sequence of dialog, narrative, music, and effects. The high realism achievable with modern entertainment audio technologies and production methods has encouraged the use of conversational speaking styles on television that differ substantially from the clearly-annunciated stage-like presentation of the past. This situation poses a problem not only for the growing population of elderly viewers who, faced with diminished sensory and language processing abilities, must strain to follow the programming but also for persons with normal hearing, for example, when listening at low acoustic levels.

How well speech is understood depends on several factors. Examples are the care of speech production (clear or conversational speech), the speaking rate, and the audibility of the speech. Spoken language is remarkably robust and can be understood under less than ideal conditions. For example, hearing-impaired listeners typically can follow clear speech even when they cannot hear parts of the speech due to diminished hearing acuity. However, as the speaking rate increases and speech production becomes less accurate, listening and comprehending require increasing effort, particularly if parts of the speech spectrum are inaudible.

Because television audiences can do nothing to affect the clarity of the broadcast speech, hearing-impaired listeners may try to compensate for inadequate audibility by increasing the listening volume. Aside from being objectionable to normal-hearing people in the same room or to neighbors, this approach is only partially effective. This is so because most hearing losses are non-uniform across frequency; they affect high frequencies more than low- and mid-frequencies. For example, a typical 70-year-old male's ability to hear sounds at 6 kHz is about 50 dB worse than that of a young person, but at frequencies below 1 kHz the older person's hearing disadvantage is less than 10 dB (ISO 7029, Acoustics—Statistical distribution of hearing thresholds as a function of age). Increasing the volume makes low- and mid-frequency sounds louder without significantly increasing their contribution to intelligibility because for those frequencies audibility is already adequate. Increasing the volume also does little to overcome the significant hearing loss at high frequencies. A more appropriate correction is a tone control, such as that provided by a graphic equalizer.

Although a better option than simply increasing the volume control, a tone control is still insufficient for most hearing losses. The large high-frequency gain required to make soft passages audible to the hearing-impaired listener is likely to be uncomfortably loud during high-level passages and may even overload the audio reproduction chain. A better solution is to amplify depending on the level of the signal, providing larger gains to low-level signal portions and smaller gains (or no gain at all) to high-level portions. Such systems, known as automatic gain controls (AGC) or dynamic range compressors (DRC) are used in hearing aids and their use to improve intelligibility for the hearing impaired in telecommunication systems has been proposed (e.g., U.S. Pat. Nos. 5,388,185, 5,539,806, and 6,061,431).

Because hearing loss generally develops gradually, most listeners with hearing difficulties have grown accustomed to their losses. As a result, they often object to the sound quality of entertainment audio when it is processed to compensate for their hearing impairment. Hearing-impaired audiences are more likely to accept the sound quality of compensated audio when it provides a tangible benefit to them, such as when it increases the intelligibility of dialog and narrative or reduces the mental effort required for comprehension. Therefore it is advantageous to limit the application of hearing loss compensation to those parts of the audio program that are dominated by speech. Doing so optimizes the tradeoff between potentially objectionable sound quality modifications of music and ambient sounds on one hand and the desirable intelligibility benefits on the other.

DISCLOSURE OF THE INVENTION

According to one aspect, a method for detecting voice activity is disclosed, the method including receiving a frame of an input audio signal, the input audio signal having an sample rate; dividing the frame into a plurality of subbands based on the sample rate, the plurality of subbands including at least a lowest subband and a highest subband; filtering the lowest subband with a moving average filter to reduce an energy of the lowest subband; estimating a noise level for each of the plurality of subbands; calculating a signal to noise ratio value for each of the plurality of subbands; and determining a speech activity level of the frame based on an average of the calculated signal to noise ratio values and a weighted average of an energy of each of the plurality of subbands. The method may also include smoothing the calculated signal to noise ratio values over time to create temporally smoothed subband signal to noise values and determining a weighted average of the calculated signal to noise ratio values as a spectral tilt of the frame. The method may also include determining a threshold value for the frame based at least on the spectral tilt of the frame and the speech activity level of the frame, and classifying the frame as a voiced frame if the threshold value is exceeded for the frame. The threshold value may additionally be based on whether a previous frame was classified as a voiced frame. Other aspects include audio decoders that decode audio that was encoded using the methods described herein.

According to aforementioned aspects of the invention the processing may include multiple functions acting in parallel. Each of the multiple functions may operate in one of multiple frequency bands. Each of the multiple functions may provide, individually or collectively, dynamic range control, dynamic equalization, spectral sharpening, frequency transposition, speech extraction, noise reduction, or other speech enhancing action. For example, dynamic range control may be provided by multiple compression/expansion functions or devices, wherein each processes a frequency region of the audio signal.

Apart from whether of not the processing includes multiple functions acting in parallel, the processing may provide dynamic range control, dynamic equalization, spectral sharpening, frequency transposition, speech extraction, noise reduction, or other speech enhancing action. For example, dynamic range control may be provided by a dynamic range compression/expansion function or device.

BEST MODE FOR CARRYING OUT THE INVENTION

Figure 1A:
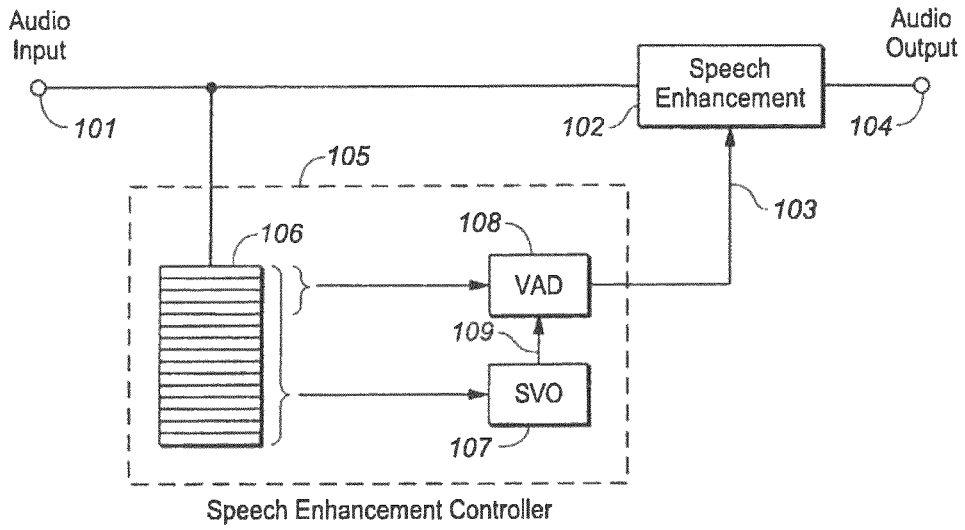
FIG. 1*a* is a schematic functional block diagram illustrating an exemplary implementation of aspects of the invention.

Techniques for classifying audio into speech and non-speech (such as music) are known in the art and are sometimes known as a speech-versus-other discriminator ("SVO"). See, for example, U.S. Pat. Nos. 6,785,645 and 6,570,991 as well as the published US Patent Application 20040044525, and the references contained therein. Speech-versus-other audio discriminators analyze time segments of an audio signal and extract one or more signal descriptors (features) from every time segment. Such features are passed to a processor that either produces a likelihood estimate of the time segment being speech or makes a hard speech/no-speech decision. Most features reflect the evolution of a signal over time. Typical examples of features are the rate at which the signal spectrum changes over time or the skew of the distribution of the rate at which the signal polarity changes. To reflect the distinct characteristics of speech reliably, the time segments must be of sufficient length. Because many features are based on signal characteristics that reflect the transitions between adjacent syllables, time segments typically cover at least the duration of two syllables (i.e., about 250 ms) to capture one such transition. However, time segments are often longer (e.g., by a factor of about 10) to achieve more reliable estimates. Although relatively slow in operation, SVOs are reasonably reliable and accurate in classifying audio into speech and non-speech. However, to enhance speech selectively in an audio program in accordance with aspects of the present invention, it is desirable to control the speech enhancement at a time scale finer than the duration of the time segments analyzed by a speech-versus-other discriminator.

Another class of techniques, sometimes known as voice activity detectors (VADs) indicates the presence or absence of speech in a background of relatively steady noise. VADs are used extensively as part of noise reduction schemas in speech communication applications. Unlike speech-versus-other discriminators, VADs usually have a temporal resolution that is adequate for the control of speech enhancement in accordance with aspects of the present invention. VADs interpret a sudden increase of signal power as the beginning of a speech sound and a sudden decrease of signal power as the end of a speech sound. By doing so, they signal the demarcation between speech and background nearly instantaneously (i.e., within a window of temporal integration to measure the signal power, e.g., about 10 ms). However, because VADs react to any sudden change of signal power, they cannot differentiate between speech and other dominant signals, such as music. Therefore, if used alone, VADs are not suitable for controlling speech enhancement to enhance speech selectively in accordance with the present invention.

It is an aspect of the invention to combine the speech versus non-speech specificity of speech-versus-other (SVO) discriminators with the temporal acuity of voice activity detectors (VADs) to facilitate speech enhancement that responds selectively to speech in an audio signal with a temporal resolution that is finer than that found in prior-art speech-versus-other discriminators.

Although, in principle, aspects of the invention may be implemented in analog and/or digital domains, practical implementations are likely to be implemented in the digital domain in which each of the audio signals are represented by individual samples or samples within blocks of data.

Referring now to FIG. 1*a,* a schematic functional block diagram illustrating aspects of the invention is shown in which an audio input signal 101 is passed to a speech enhancement function or device ("Speech Enhancement") 102 that, when enabled by a control signal 103, produces a speech-enhanced audio output signal 104. The control signal is generated by a control function or device ("Speech Enhancement Controller") 105 that operates on buffered time segments of the audio input signal 101. Speech Enhancement Controller 105 includes a speech-versus-other discriminator function or device ("SVO") 107 and a set of one or more voice activity detector functions or devices ("VAD") 108. The SVO 107 analyzes the signal over a time span that is longer than that analyzed by the VAD. The fact that SVO 107 and VAD 108 operate over time spans of different lengths is illustrated pictorially by a bracket accessing a wide region (associated with the SVO 107) and another bracket accessing a narrower region (associated with the VAD 108) of a signal buffer function or device ("Buffer") 106. The wide region and the narrower region are schematic and not to scale. In the case of a digital implementation in which the audio data is carried in blocks, each portion of Buffer 106 may store a block of audio data. The region accessed by the VAD includes the most-recent portions of the signal store in the Buffer 106. The likelihood of the current signal section being speech, as determined by SVO 107, serves to control 109 the VAD 108. For example, it may control a decision criterion of the VAD 108, thereby biasing the decisions of the VAD.

Buffer 106 symbolizes memory inherent to the processing and may or may not be implemented directly. For example, if processing is performed on an audio signal that is stored on a medium with random memory access, that medium may serve as buffer. Similarly, the history of the audio input may be reflected in the internal state of the speech-versus-other discriminator 107 and the internal state of the voice activity detector, in which case no separate buffer is needed.

Speech Enhancement 102 may be composed of multiple audio processing devices or functions that work in parallel to enhance speech. Each device or function may operate in a frequency region of the audio signal in which speech is to be enhanced. For example, the devices or functions may provide, individually or as whole, dynamic range control, dynamic equalization, spectral sharpening, frequency transposition, speech extraction, noise reduction, or other speech enhancing action. In the detailed examples of aspects of the invention, dynamic range control provides compression and/or expansion in frequency bands of the audio signal. Thus, for example, Speech Enhancement 102 may be a bank of dynamic range compressors/expanders or compression/expansion functions, wherein each processes a frequency region of the audio signal (a multiband compressor/expander or compression/expansion function). The frequency specificity afforded by multiband compression/expansion is useful not only because it allows tailoring the pattern of speech enhancement to the pattern of a given hearing loss, but also because it allows responding to the fact that at any given moment speech may be present in one frequency region but absent in another.

To take full advantage of the frequency specificity offered by multiband compression, each compression/expansion band may be controlled by its own voice activity detector or detection function. In such a case, each voice activity detector or detection function may signal voice activity in the frequency region associated with the compression/expansion band it controls. Although there are advantages in Speech Enhancement 102 being composed of several audio processing devices or functions that work in parallel, simple embodiments of aspects of the invention may employ a Speech Enhancement 102 that is composed of only a single audio processing device or function.

Even when there are many voice activity detectors, there may be only one speech-versus-other discriminator 107 generating a single output 109 to control all the voice activity detectors that are present. The choice to use only one speech-versus-other discriminator reflects two observations. One is that the rate at which the across-band pattern of voice activity changes with time is typically much faster than the temporal resolution of the speech-versus-other discriminator. The other observation is that the features used by the speech-versus-other discriminator typically are derived from spectral characteristics that can be observed best in a broadband signal. Both observations render the use of band-specific speech-versus-other discriminators impractical.

A combination of SVO 107 and VAD 108 as illustrated in Speech Enhancement Controller 105 may also be used for purposes other than to enhance speech, for example to estimate the loudness of the speech in an audio program, or to measure the speaking rate.

The speech enhancement schema just described may be deployed in many ways. For example, the entire schema may be implemented inside a television or a set-top box to operate on the received audio signal of a television broadcast. Alternatively, it may be integrated with a perceptual audio coder (e.g., AC-3 or AAC) or it may be integrated with a lossless audio coder.

Speech enhancement in accordance with aspects of the present invention may be executed at different times or in different places. Consider an example in which speech enhancement is integrated or associated with an audio coder or coding process. In such a case, the speech-versus other discriminator (SVO) 107 portion of the Speech Enhancement Controller 105, which often is computationally expensive, may be integrated or associated with the audio encoder or encoding process. The SVO's output 109, for example a flag indicating speech presence, may be embedded in the coded audio stream. Such information embedded in a coded audio stream is often referred to as metadata. Speech Enhancement 102 and the VAD 108 of the Speech Enhancement Controller 105 may be integrated or associated with an audio decoder and operate on the previously encoded audio. The set of one or more voice activity detectors (VAD) 108 also uses the output 109 of the speech-versus-other discriminator (SVO) 107, which it extracts from the coded audio stream.

Figure 1B:
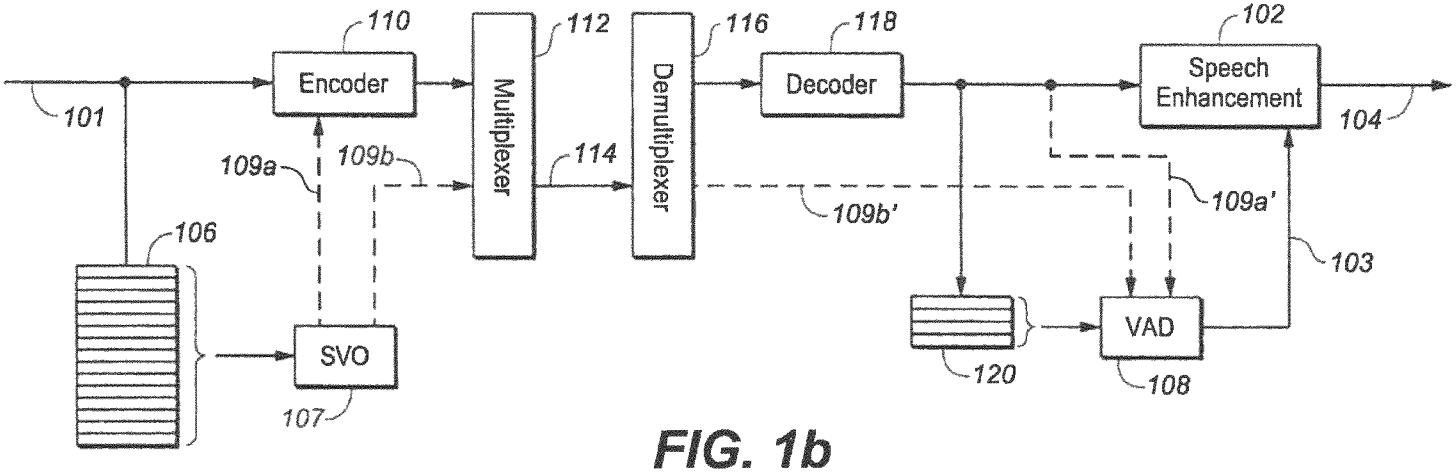
FIG. 1*b* is a schematic functional block diagram showing an exemplary implementation of a modified version of FIG. 1*a* in which devices and/or functions may be separated temporally and/or spatially.

FIG. 1*b* shows an exemplary implementation of such a modified version of FIG. 1*a*. Devices or functions in FIG. 1*b* that correspond to those in FIG. 1*a* bear the same reference numerals. The audio input signal 101 is passed to an encoder or encoding function ("Encoder") 110 and to a Buffer 106 that covers the time span required by SVO 107. Encoder 110 may be part of a perceptual or lossless coding system. The Encoder 110 output is passed to a multiplexer or multiplexing function ("Multiplexer") 112. The SVO output (109 in FIG. 1*a*) is shown as being applied 109*a* to Encoder 110 or, alternatively, applied 109*b* to Multiplexer 112 that also receives the Encoder 110 output. The SVO output, such as a flag as in FIG. 1*a*, is either carried in the Encoder 110 bitstream output (as metadata, for example) or is multiplexed with the Encoder 110 output to provide a packed and assembled bitstream 114 for storage or transmission to a demultiplexer or demultiplexing function ("Demultiplexer") 116 that unpacks the bitstream 114 for passing to a decoder or decoding function 118. If the SVO 107 output was passed 109*b* to Multiplexer 112, then it is received 109*b*' from the Demultiplexer 116 and passed to VAD 108. Alternatively, if the SVO 107 output was passed 109*a* to Encoder 110, then it is received 109*a*' from the Decoder 118. As in the FIG. 1*a* example, VAD 108 may comprise multiple voice activity functions or devices. A signal buffer function or device ("Buffer") 120 fed by the Decoder 118 that covers the time span required by VAD 108 provides another feed to VAD 108. The VAD output 103 is passed to a Speech Enhancement 102 that provides the enhanced speech audio output as in FIG. 1*a*. Although shown separately for clarity in presentation, SVO 107 and/or Buffer 106 may be integrated with Encoder 110. Similarly, although shown separately for clarity in presentation, VAD 108 and/or Buffer 120 may be integrated with Decoder 118 or Speech Enhancement 102.

Figure 2:
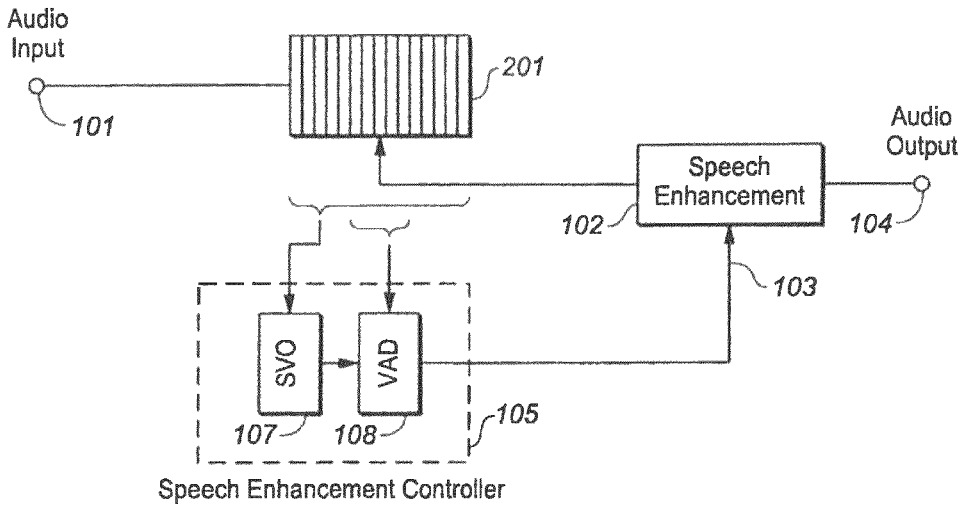
FIG. 2 is a schematic functional block diagram showing an exemplary implementation of a modified version of FIG. 1*a* in which the speech enhancement control is derived in a "look ahead" manner.

If the audio signal to be processed has been prerecorded, for example as when playing back from a DVD in a consumer's home or when processing offline in a broadcast environment, the speech-versus-other discriminator and/or the voice activity detector may operate on signal sections that include signal portions that, during playback, occur after the current signal sample or signal block. This is illustrated in FIG. 2, where the symbolic signal buffer 201 contains signal sections that, during playback, occur after the current signal sample or signal block ("look ahead"). Even if the signal has not been pre-recorded, look ahead may still be used when the audio encoder has a substantial inherent processing delay.

Figure 3A:
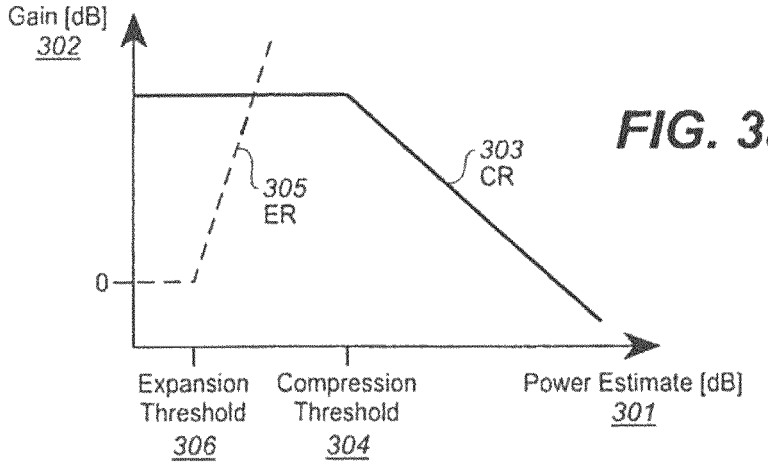
FIG. 3*a-c* are examples of power-to-gain transformations useful in understand the example of FIG. 4.
Figure 3B:
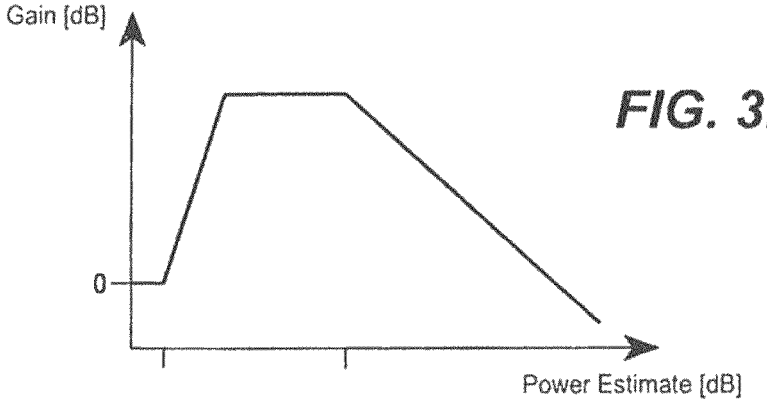
Figure 3C:
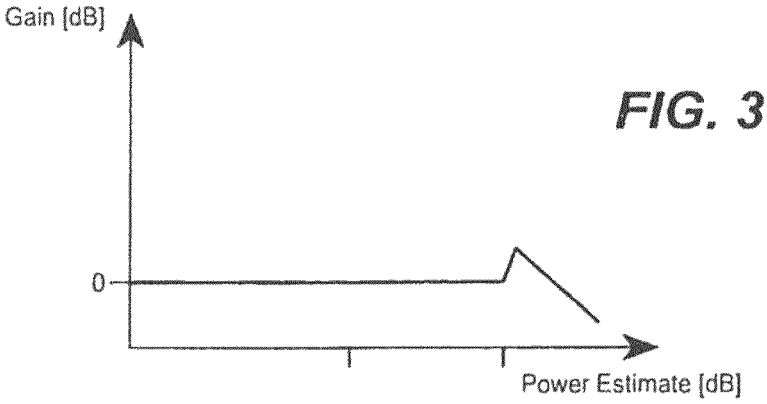

The processing parameters of Speech Enhancement 102 may be updated in response to the processed audio signal at a rate that is lower than the dynamic response rate of the compressor. There are several objectives one might pursue when updating the processor parameters. For example, the gain function processing parameter of the speech enhancement processor may be adjusted in response to the average speech level of the program to ensure that the change of the long-term average speech spectrum is independent of the speech level. To understand the effect of and need for such an adjustment, consider the following example. Speech enhancement is applied only to a high-frequency portion of a signal. At a given average speech level, the power estimate 301 of the high-frequency signal portion averages P1, where P1 is larger than the compression threshold power 304. The gain associated with this power estimate is G1, which is the average gain applied to the high-frequency portion of the signal. Because the low-frequency portion receives no gain, the average speech spectrum is shaped to be G1 dB higher at the high frequencies than at the low frequencies. Now consider what happens when the average speech level increases by a certain amount, ΔL. An increase of the average speech level by ΔL dB increases the average power estimate 301 of the high-frequency signal portion to P2=P1+ΔL. As can be seen from FIG. 3*a*, the higher power estimate P2 gives raise to a gain, G2 that is smaller than G1. Consequently, the average speech spectrum of the processed signal shows smaller high-frequency emphasis when the average level of the input is high than when it is low. Because listeners compensate for differences in the average speech level with their volume control, the level dependence of the average high-frequency emphasis is undesirable. It can be eliminated by modifying the gain curve of FIGS. 3*a-c* in response to the average speech level. FIGS. 3*a-c* are discussed below.

Processing parameters of Speech Enhancement 102 may also be adjusted to ensure that a metric of speech intelligibility is either maximized or is urged above a desired threshold level. The speech intelligibility metric may be computed from the relative levels of the audio signal and a competing sound in the listening environment (such as aircraft cabin noise). When the audio signal is a multichannel audio signal with speech in one channel and non-speech signals in the remaining channels, the speech intelligibility metric may be computed, for example, from the relative levels of all channels and the distribution of spectral energy in them. Suitable intelligibility metrics are well known [e.g., ANSI S3.5-1997 "Method for Calculation of the Speech Intelligibility Index" American National Standards Institute, 1997; or Müsch and Buus, "Using statistical decision theory to predict speech intelligibility. I Model Structure," Journal of the Acoustical Society of America, (2001) 109, pp 2896-2909].

Aspects of the invention shown in the functional block diagrams of FIGS. 1*a* and 1*b* and described herein may be implemented as in the example of FIGS. 3*a-c* and 4. In this example, frequency-shaping compression amplification of speech components and release from processing for non-speech components may be realized through a multiband dynamic range processor (not shown) that implements both compressive and expansive characteristics. Such a processor may be characterized by a set of gain functions. Each gain function relates the input power in a frequency band to a corresponding band gain, which may be applied to the signal components in that band. One such relation is illustrated in FIGS. 3*a-c*.

Referring to FIG. 3*a*, the estimate of the band input power 301 is related to a desired band gain 302 by a gain curve. That gain curve is taken as the minimum of two constituent curves. One constituent curve, shown by the solid line, has a compressive characteristic with an appropriately chosen compression ratio ("CR") 303 for power estimates 301 above a compression threshold 304 and a constant gain for power estimates below the compression threshold. The other constituent curve, shown by the dashed line, has an expansive characteristic with an appropriately chosen expansion ratio ("ER") 305 for power estimates above the expansion threshold 306 and a gain of zero for power estimates below. The final gain curve is taken as the minimum of these two constituent curves.

The compression threshold 304, the compression ratio 303, and the gain at the compression threshold are fixed parameters. Their choice determines how the envelope and spectrum of the speech signal are processed in a particular band. Ideally they are selected according to a prescriptive formula that determines appropriate gains and compression ratios in respective bands for a group of listeners given their hearing acuity. An example of such a prescriptive formula is NAL−NL1, which was developed by the National Acoustics Laboratory, Australia, and is described by H. Dillon in "Prescribing hearing aid performance" [H. Dillon (Ed.), Hearing Aids (pp. 249-261); Sydney; Boomerang Press, 2001.] However, they may also be based simply on listener preference. The compression threshold 304 and compression ratio 303 in a particular band may further depend on parameters specific to a given audio program, such as the average level of dialog in a movie soundtrack.

Whereas the compression threshold may be fixed, the expansion threshold 306 preferably is adaptive and varies in response to the input signal. The expansion threshold may assume any value within the dynamic range of the system, including values larger than the compression threshold. When the input signal is dominated by speech, a control signal described below drives the expansion threshold towards low levels so that the input level is higher than the range of power estimates to which expansion is applied (see FIGS. 3*a* and 3*b*). In that condition, the gains applied to the signal are dominated by the compressive characteristic of the processor. FIG. 3*b* depicts a gain function example representing such a condition.

When the input signal is dominated by audio other than speech, the control signal drives the expansion threshold towards high levels so that the input level tends to be lower than the expansion threshold. In that condition the majority of the signal components receive no gain. FIG. 3*c* depicts a gain function example representing such a condition.

The band power estimates of the preceding discussion may be derived by analyzing the outputs of a filter bank or the output of a time-to-frequency domain transformation, such as the DFT (discrete Fourier transform), MDCT (modified discrete cosine transform) or wavelet transforms. The power estimates may also be replaced by measures that are related to signal strength such as the mean absolute value of the signal, the Teager energy, or by perceptual measures such as loudness. In addition, the band power estimates may be smoothed in time to control the rate at which the gain changes.

According to an aspect of the invention, the expansion threshold is ideally placed such that when the signal is speech the signal level is above the expansive region of the gain function and when the signal is audio other than speech the signal level is below the expansive region of the gain function. As is explained below, this may be achieved by tracking the level of the non-speech audio and placing the expansion threshold in relation to that level.

Certain prior art level trackers set a threshold below which downward expansion (or squelch) is applied as part of a noise reduction system that seeks to discriminate between desirable audio and undesirable noise. See, e.g., U.S. Pat. Nos. 3,803,357, 5,263,091, 5,774,557, and 6,005,953. In contrast, aspects of the present invention require differentiating between speech on one hand and all remaining audio signals, such as music and effects, on the other. Noise tracked in the prior art is characterized by temporal and spectral envelopes that fluctuate much less than those of desirable audio. In addition, noise often has distinctive spectral shapes that are known a priori. Such differentiating characteristics are exploited by noise trackers in the prior art. In contrast, aspects of the present invention track the level of non-speech audio signals. In many cases, such non-speech audio signals exhibit variations in their envelope and spectral shape that are at least as large as those of speech audio signals. Consequently, a level tracker employed in the present invention requires analyzing signal features suitable for the distinction between speech and non-speech audio rather than between speech and noise.

Figure 4:
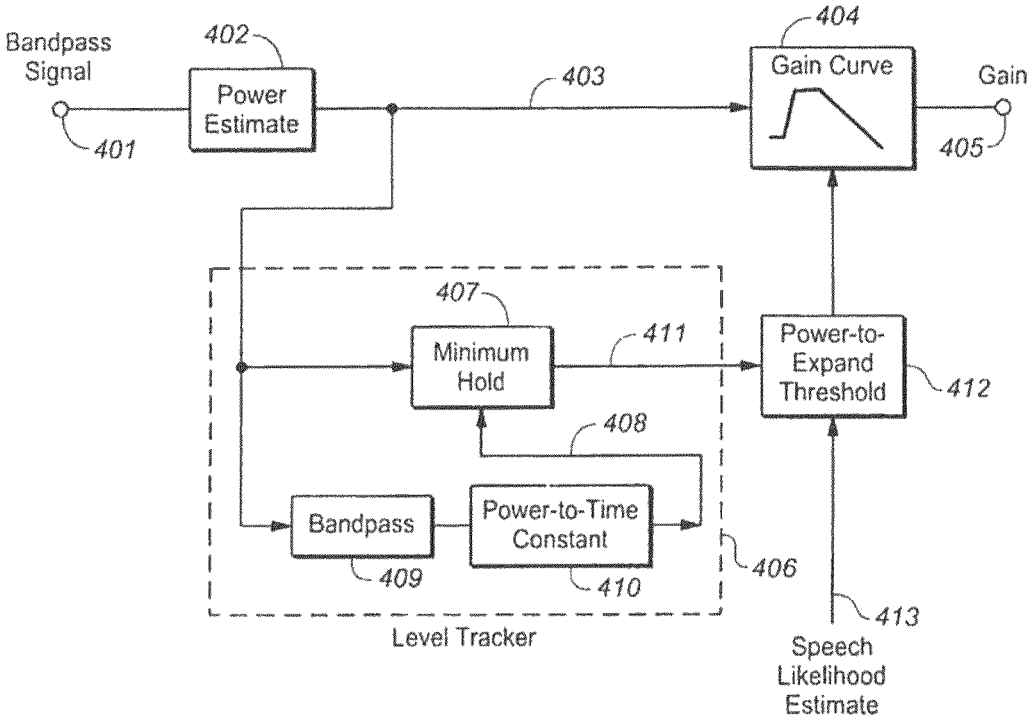
FIG. 4 is a schematic functional block diagram showing how the speech enhancement gain in a frequency band may be derived from the signal power estimate of that band in accordance with aspects of the invention.

FIG. 4 shows how the speech enhancement gain in a frequency band may be derived from the signal power estimate of that band. Referring now to FIG. 4, a representation of a band-limited signal 401 is passed to a power estimator or estimating device ("Power Estimate") 402 that generates an estimate of the signal power 403 in that frequency band. That signal power estimate is passed to a power-to-gain transformation or transformation function ("Gain Curve") 404, which may be of the form of the example illustrated in FIGS. 3*a-c*. The power-to-gain transformation or transformation function 404 generates a band gain 405 that may be used to modify the signal power in the band (not shown).

The signal power estimate 403 is also passed to a device or function ("Level Tracker") 406 that tracks the level of all signal components in the band that are not speech. Level Tracker 406 may include a leaky minimum hold circuit or function ("Minimum Hold") 407 with an adaptive leak rate. This leak rate is controlled by a time constant 408 that tends to be low when the signal power is dominated by speech and high when the signal power is dominated by audio other than speech. The time constant 408 may be derived from information contained in the estimate of the signal power 403 in the band. Specifically, the time constant may be monotonically related to the energy of the band signal envelope in the frequency range between 4 and 8 Hz. That feature may be extracted by an appropriately tuned bandpass filter or filtering function ("Bandpass") 409. The output of Bandpass 409 may be related to the time constant 408 by a transfer function ("Power-to-Time-Constant") 410. The level estimate of the non-speech components 411, which is generated by Level Tracker 406, is the input to a transform or transform function ("Power-to-Expansion Threshold") 412 that relates the estimate of the background level to an expansion threshold 414. The combination of level tracker 406, transform 412, and downward expansion (characterized by the expansion ratio 305) corresponds to the VAD 108 of FIGS. 1*a* and 1*b*.

Transform 412 may be a simple addition, i.e., the expansion threshold 306 may be a fixed number of decibels above the estimated level of the non-speech audio 411. Alternatively, the transform 412 that relates the estimated background level 411 to the expansion threshold 306 may depend on an independent estimate of the likelihood of the broadband signal being speech 413. Thus, when estimate 413 indicates a high likelihood of the signal being speech, the expansion threshold 306 is lowered. Conversely, when estimate 413 indicates a low likelihood of the signal being speech, the expansion threshold 306 is increased. The speech likelihood estimate 413 may be derived from a single signal feature or from a combination of signal features that distinguish speech from other signals. It corresponds to the output 109 of the SVO 107 in FIGS. 1*a* and 1*b*. Suitable signal features and methods of processing them to derive an estimate of speech likelihood 413 are known to those skilled in the art. Examples are described in U.S. Pat. Nos. 6,785,645 and 6,570,991 as well as in the US patent application 20040044525, and in the references contained therein.

INCORPORATION BY REFERENCE

The following patents, patent applications and publications are hereby incorporated by reference, each in their entirety.

U.S. Pat. No. 3,803,357; Sacks, Apr. 9, 1974, Noise Filter

U.S. Pat. No. 5,263,091; Waller, Jr. Nov. 16, 1993, Intelligent automatic threshold circuit U.S. Pat. No. 5,388,185; Terry, et al. Feb. 7, 1995, System for adaptive processing of telephone voice signals U.S. Pat. No. 5,539,806; Allen, et al. Jul. 23, 1996, Method for customer selection of telephone sound enhancement U.S. Pat. No. 5,774,557; Slater Jun. 30, 1998, Autotracking microphone squelch for aircraft intercom systems U.S. Pat. No. 6,005,953; Stuhlfelner Dec. 21, 1999, Circuit arrangement for improving the signal-to-noise ratio U.S. Pat. No. 6,061,431; Knappe, et al. May 9, 2000, Method for hearing loss compensation in telephony systems based on telephone number resolution U.S. Pat. No. 6,570,991; Scheirer, et al. May 27, 2003, Multi-feature speech/music discrimination system U.S. Pat. No. 6,785,645; Khalil, et al. Aug. 31, 2004, Real-time speech and music classifier U.S. Pat. No. 6,914,988; Irwan, et al. Jul. 5, 2005, Audio reproducing device United States Published Patent Application 2004/0044525; Vinton, Mark Stuart; et al. Mar. 4, 2004, controlling loudness of speech in signals that contain speech and other types of audio material "Dynamic Range Control via Metadata" by Charles Q. Robinson and Kenneth Gundry, Convention Paper 5028, 107$^{th}$ Audio Engineering Society Convention, New York, Sep. 24-27, 1999.

IMPLEMENTATION

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

I claim:

1. A method for determining voice activity in an audio signal, the method comprising:

receiving a frame of an input audio signal, the input audio signal having a sample rate;

spitting the audio signal into a plurality of subbands, the plurality of subbands including at least a lowest subband and a highest subband;

filtering the lowest subband to reduce an energy of the lowest subband;

estimating a noise level for at least some of the plurality of subbands;

computing a signal-to-noise ratio for at least some of the plurality of subbands; and determining a speech activity level based at least in part on the computed signal-to-noise ratios and an average of an energy of at least some of the plurality of subbands, wherein the method is performed in an audio encoder with one or more processors.

2. The method of claim 1 further comprising smoothing the computed signal-to-noise ratios over time to create temporally smoothed subband signal-to-noise ratios.

3. The method of claim 1 further comprising determining a weighted average of the computed signal-to-noise ratios as a spectral tilt of the frame.

4. The method of claim 1, wherein the signal-to-noise ratio is computed as a logarithm of a ratio of an energy-to-noise level.

5. An audio processing apparatus for decoding an encoded audio signal, wherein the audio processing apparatus comprises a demultiplexer for unpacking the encoded audio signal and an audio decoder for decoding the encoded audio signal, wherein the encoded audio signal was generated using at least in part the method of claim 1.

6. A non-transitory computer readable medium comprising instructions that when executed by a processor of an audio processing device cause the audio processing device to perform the method of claim 1.

* * * * *